US005701562A

United States Patent [19]

Araki et al.

[11] Patent Number: 5,701,562

[45] Date of Patent: Dec. 23, 1997

[54] DEVELOPING SLEEVE HAVING A CYLINDRICAL PORTION AND A NON-CYLINDRICAL PORTION PROVIDED BY THE SAME MEMBER, AND DEVELOPING DEVICE USING THE SLEEVE

[75] Inventors: Ryuji Araki, Kawasaki; Atsushi Kubota, Machida; Shinichi Sasaki, Fujisawa; Koji Miura, Sagamihara, all of Japan

[73] Assignee: Canon Kabushiki Kaisha, Tokyo, Japan

[21] Appl. No.: 625,094

[22] Filed: Apr. 1, 1996

Related U.S. Application Data

[63] Continuation of Ser. No. 248,494, May 24, 1994, abandoned.

[30] Foreign Application Priority Data

May 26, 1993 [JP] Japan ..... 5-123970

[51] Int. Cl.[6] ..... G03G 15/08

[52] U.S. Cl. ..... 399/265; 399/279

[58] Field of Search ..... 355/251, 253, 355/259; 492/16, 17, 47, 48; 399/265, 276, 279, 286

[56] References Cited

U.S. PATENT DOCUMENTS

| | | | |
|---|---|---|---|
| 4,205,622 | 6/1980 | Miyake et al. | 118/661 |
| 4,373,468 | 2/1983 | Suda et al. | 118/658 |
| 4,449,810 | 5/1984 | Ikesue et al. | 118/658 X |
| 4,557,582 | 12/1985 | Kan et al. | 118/657 X |
| 4,768,050 | 8/1988 | Beery | 354/304 |
| 4,806,971 | 2/1989 | Masham | 118/657 X |
| 4,951,599 | 8/1990 | Damji | 118/657 |
| 4,956,674 | 9/1990 | Kalyandura | 355/251 |
| 5,166,731 | 11/1992 | Aimoto et al. | 355/215 |
| 5,267,007 | 11/1993 | Watanabe et al. | 355/245 |
| 5,283,619 | 2/1994 | Nomura et al. | 355/261 |
| 5,294,960 | 3/1994 | Nomura et al. | 355/210 |
| 5,319,337 | 6/1994 | Matsunari et al. | 355/303 |
| 5,327,197 | 7/1994 | Matsuura et al. | 355/213 |
| 5,345,294 | 9/1994 | Nomura et al. | 355/200 |

FOREIGN PATENT DOCUMENTS

| | | | |
|---|---|---|---|
| 7505988 | 9/1975 | Netherlands | 355/259 |

*Primary Examiner*—William J. Royer

*Attorney, Agent, or Firm*—Fitzpatrick, Cella, Harper & Scinto

[57] ABSTRACT

A developing sleeve including a cylindrical portion having a circular cross-sectional shape, and a non-cylindrical portion having a non-circular cross-sectional shape integral with the cylindrical portion, is disclosed, for use in a developing device.

16 Claims, 4 Drawing Sheets

DEVELOPING SLEEVE HAVING A CYLINDRICAL PORTION AND A NON-CYLINDRICAL PORTION PROVIDED BY THE SAME MEMBER, AND DEVELOPING DEVICE USING THE SLEEVE

This application is a continuation of application Ser. No. 08/248,494 filed May 24, 1994, now abandoned.

BACKGROUND OF THE INVENTION

1. Field of the Invention

This invention relates to a developing sleeve carrying thereon a developer including of either a toner or a toner and a carrier, and to a developing device using the developing sleeve.

2. Related Background Art

In an image forming apparatus such as a printer, a uniformly charged image bearing member is subjected to selective exposure, whereby an electrostatic latent image is formed on the surface thereof, and the electrostatic latent image is visualized as a toner image by toner adhering to the developer carrying member of a developing device. The toner image is transferred to a recording medium to thereby accomplish image recording.

It is widely practised to use as the developing device a cylindrical developing sleeve opposed to the image bearing member.

FIG. 6 of the accompanying drawings shows an example of a developing sleeve in accordance with the background of the present invention.

A flange 33*c* is attached to at least one end portion of a sleeve 33*a* by an adhesive or caulking, and the flange 33*c* has mounted thereon a gear, not shown, for driving the developing sleeve 33*a*, and a slide bearing 33*f* for rotatably supporting the developing sleeve 33*a*.

Also, on the image forming area of the developing sleeve 33*a*, there is formed a resin coating layer 33*e* for improving the electrical conductivity, lubricity and chargeability of the developing sleeve 33*a* to thereby enhance the developing property thereof.

However, such a developing sleeve suffers from the following problems.

Since the flange 33*c* is constructed discretely from the developing sleeve 33*a*, it is necessary to assemble the flange 33*c* with the developing sleeve 33*a* by an adhesive or caulking after they have been worked or molded.

Also, it is necessary to form the flange 33*c* into a shape for stopping the rotation of the gear by working after cutting or the like.

Further, where the flange 33*c* is made of a metal and the slide bearing 33*f* is made of resin, the wear of the slide bearing 33*f* is great and the coefficient of friction thereof is relatively great and therefore, a great rotational torque has been necessary for the rotating of the developing sleeve 33*a*.

SUMMARY OF THE INVENTION

It is an object of the present invention to provide a developing sleeve having a small number of parts and simple to assemble, and a developing device using such developing sleeve.

It is another object of the present invention to provide a developing sleeve in which the wear of a slide bearing is reduced, and a developing device using such developing sleeve.

It is still another object of the present invention to provide a developing sleeve including a cylindrical portion having a circular cross-sectional shape and a non-cylindrical portion having a non-circular cross-sectional shape integral with the cylindrical portion.

Further objects of the present invention will become apparent from the following detailed description of the invention.

DESCRIPTION OF THE PREFERRED EMBODIMENTS

Several embodiments of the present invention will hereinafter be described with reference to the drawings.

Figure 4:
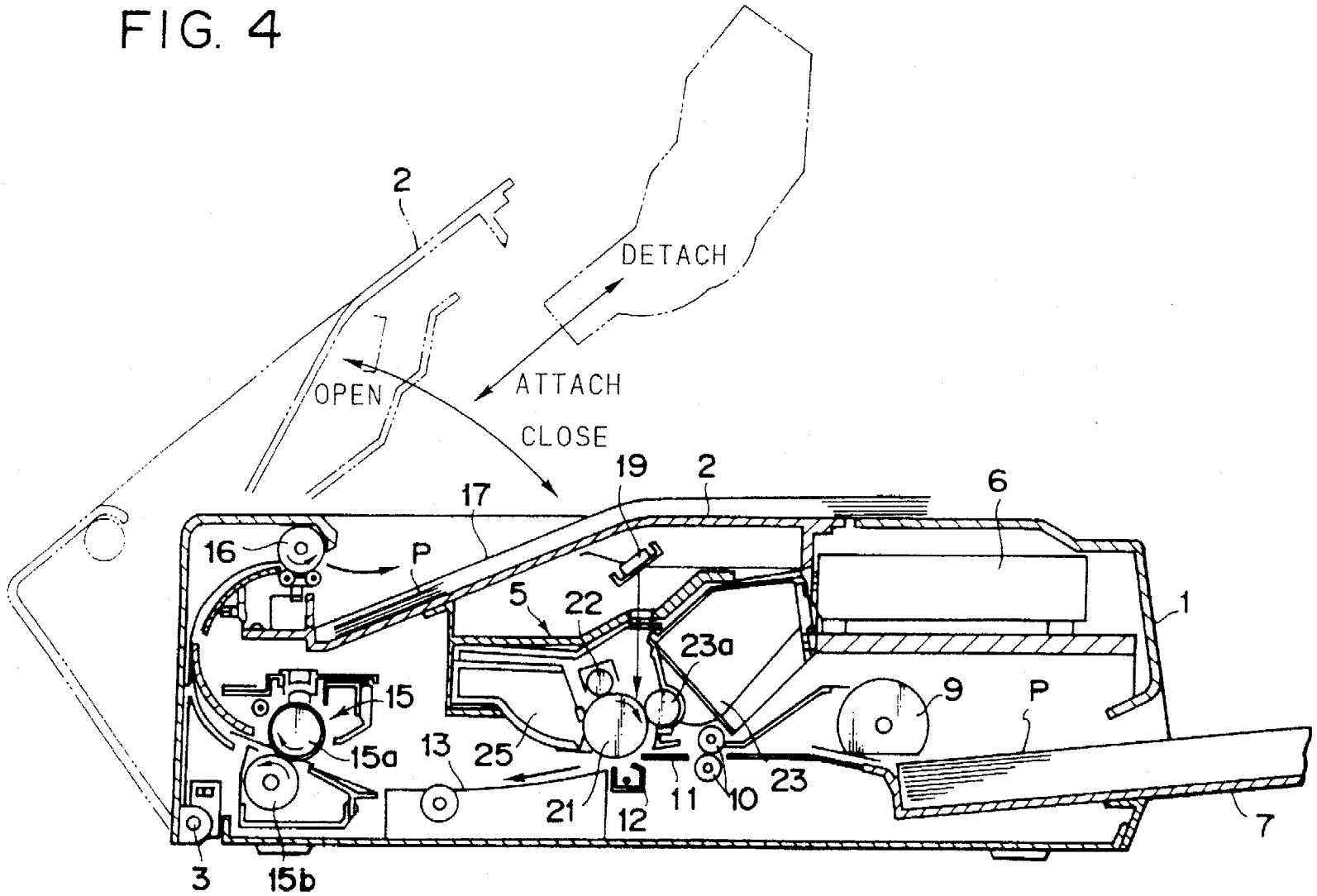
FIG. 4 is a longitudinal cross-sectional view of an image forming apparatus (laser beam printer) provided with a developing device according to the present invention and a process cartridge.

FIG. 4 is a cross-sectional view of an image forming apparatus having a developing sleeve according to an embodiment of the present invention in a developing device.

This image forming apparatus (laser beam printer) has a lower housing 1 and an upper housing 2 openable and closable relative to the lower housing 1. The upper housing 2 is pivotally connected to the lower housing 1 for pivotal movement in the directions of the arrow about a hinge shaft 3 on the inner side (the left side as viewed in FIG. 4) of the lower housing 1, and can assume an open position as indicated by dots-and-dash line in FIG. 4 and a closed position as indicated by solid line in FIG. 4. When the upper housing 2 is in the open position, it becomes possible to attach and detach a process cartridge 5 in the directions of the arrow.

In a state in which the process cartridge 5 is mounted at a predetermined position in the lower housing 1 and the upper housing 2 is closed, a laser beam scanner unit 6 constituting the essential portion of an exposing device is disposed on this side (the right side as viewed in FIG. 4) of the process cartridge 5 and a sheet cassette 7 containing therein sheet materials P which are recording mediums are disposed below the laser beam scanner unit. On the downstream side of the sheet cassette 7, there are disposed a sheet feeding roller 9, a pair of register rollers 10, a transfer guide 11, a transfer charger 12, a conveying member 13, a fixing device 15, etc. along the direction of conveyance of the sheet materials P. These are all disposed on the lower housing 1 side.

On the other hand, on the upper housing 2 side, there are disposed a sheet discharging roller 16, a sheet discharge tray 17, a reflecting mirror 19 and the process cartridge 5.

Figure 5:
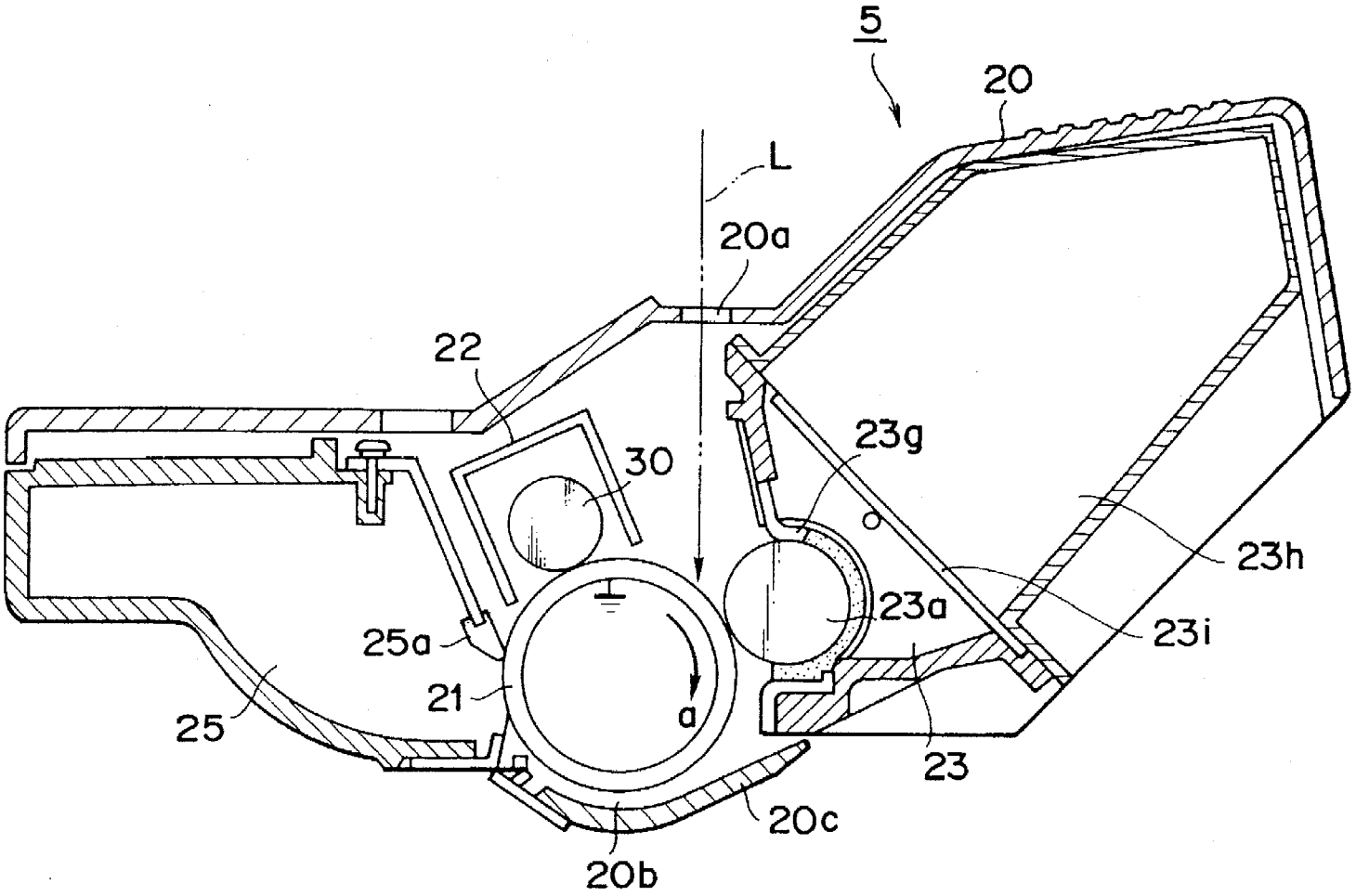
FIG. 5 is a longitudinal cross-sectional view of a process cartridge according to the present invention.

FIG. 5 is a cross-sectional view of a process cartridge having a developing device 23. The process cartridge 5 is constructed as a unit containing integrally in a cartridge frame member 20 four process instruments, i.e., a rotatable photosensitive drum 21 which is an image bearing member, a charger 22, a developing device 23 and a cleaning device 25. An exposure window portion 20*a* is formed in the upper surface of the frame member 20, and an openable and closable cover 20*c* for openably closing the exposure opening portion 20*b* of the photosensitive drum 21 is provided on the lower surface of the frame member 20. This openable and closable cover 20*c* is moved to its closed position when the process cartridge 5 is taken out of the image forming apparatus body (the upper housing 2) and when the upper housing 2 is opened, and covers and protects the photosensitive surface of the photosensitive drum 21.

The reference character 23*h* designates a containing portion containing therein a powder toner as a developer, and by removing a seal 23*i*, the toner is supplied toward the developing sleeve 23*a*.

The reference character 23*g* denotes an elastic blade for regulating the thickness of the toner layer on the sleeve and imparting tribo to the toner.

The epitome of the image forming operation of the image forming apparatus will now be described.

On the basis of a print start signal, the photosensitive drum 21 is rotatively driven in the direction of arrow a (clockwise direction) at a predetermined peripheral speed (process speed). A charging roller 30 having a bias voltage applied thereto is in contact with the outer peripheral surface of the photosensitive drum 21, and the outer peripheral surface of the photosensitive drum 21 is uniformly charged by the charging roller 30.

A laser beam L modulated in accordance with a time-serial electrical digital pixel signal of desired image information is outputted from the laser beam scanner unit 6, and this modulated laser beam L is reflected by the reflecting mirror 19, enters the cartridge frame member 20 through the exposure window portion 20*a* formed in the upper surface of the cartridge frame member 20 and scans the charged surface of the photosensitive drum 21. Thereby, an electrostatic latent image corresponding to the desired image information is formed on the outer peripheral surface of the photosensitive drum 21, and this electrostatic latent image is visualized as a toner image by the developer (toner) applied onto the developing sleeve 23*a* and having its layer thickness regulated by the developing blade 23*g* of the developing device 23.

On the other hand, the sheet materials P are supplied one by one from the sheet cassette 7 by the sheet feeding roller 9, and the sheet material P is supplied to the transfer position between the photosensitive drum 21 and the transfer charger 12 through the transfer guide 11 in timed relationship with the emission of the laser by the pair of register rollers 10. Thereby the toner image borne on the photosensitive drum 21 is transferred onto the sheet material P.

The sheet material P onto which the toner image has been transferred is then separated from the photosensitive drum 21, is conveyed to the fixing device 15 by the conveying member 13, and passes 10 through the nip portion between a fixing roller 15*a* and a pressing roller 15*b* in the fixing device 15, whereby the sheet material P is subjected to a toner image fixing process, and is discharged onto the sheet discharge tray 17 by the sheet discharging roller 16. Any residual toner remaining on the outer peripheral surface of the photosensitive drum 21 after the transfer of the toner image may be surface removed by blade 25*a* of the cleaning device 25 and used in the next cycle of image formation.

Figure 1:
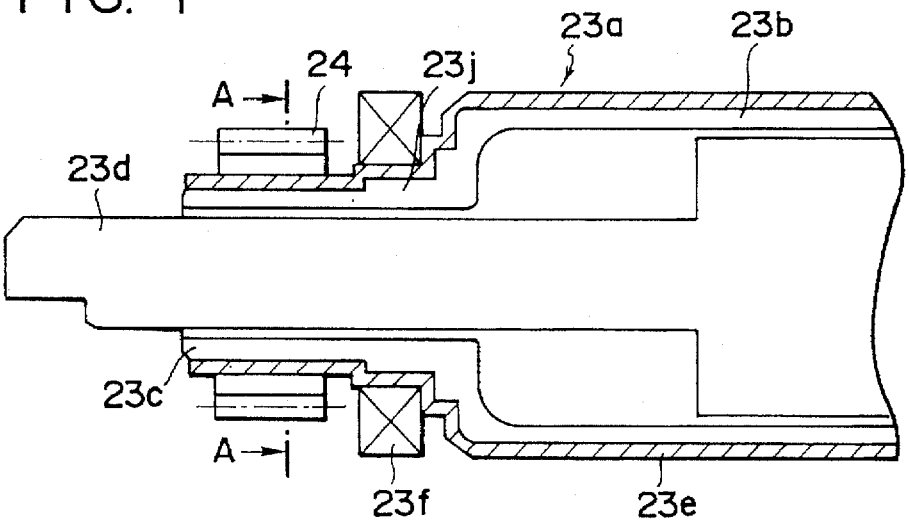
FIG. 1 is a cross-sectional view of one end portion of the developing sleeve of a developing device according to the present invention.
Figure 2:
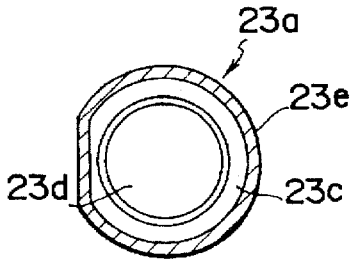
FIG. 2 is a cross-sectional view taken along the line A—A of FIG. 1.

FIG. 1 is a cross-sectional view of one end portion of the developing sleeve 23*a*, and FIG. 2 is a cross-sectional view of the sleeve 23*a* taken along the line A—A of FIG. 1. As shown, a magnet 23*d* having a plurality of magnetic poles is inserted in the hollow developing sleeve 23*a*, and the developing sleeve 23*a* is rotated about the magnet 23*d*, whereby as previously described, the toner is carried on the developing sleeve 23*a* and is used for development.

Thus, in the present embodiment, the developing sleeve 23*a* is integrally formed with a cylindrical portion 23*b* of circular cross-sectional shape, a small-diametered portion 23*j* for mounting a slide bearing 23*f* and smaller in diameter than the cylindrical portion 23*b*, and a flange portion 23*c* for mounting a gear. Specifically, the developing sleeve 23*a* is formed as a unit by drawing or forging the end portion of a sleeve blank made of a metal, and the mounting part of the flange portion 23*c* for the slide bearing 23*f* is finished to high accuracy by cutting in post-working.

Thus, according to the present embodiment, the developing sleeve 23*a* is formed as a unit including the flange portion 23*c* as described above and therefore, the number of parts is reduced, and the work of assembling the developing sleeve and the flange which are discrete from each other as in the prior art becomes unnecessary.

Also, the flange portion 23*c* of the developing sleeve 23*a* has a D-shaped cross-section formed by cutting away a part of a circle, as shown in FIG. 2, and this cross-sectional shape is designed for stopping the rotation of the gear 24 and is formed simultaneously with the formation of the developing sleeve 23*a* and therefore, the post-working cutting becomes unnecessary and the number of working steps is reduced and thus, a reduction in the costs of the developing sleeve 23*a*, the developing device 23 and further the process cartridge 5 is achieved.

However, in the above-described case, the flange portion 23*c* of the developing sleeve 23*a* is formed by the same metallic material as the blank tube and therefore is liable to cause wear of the slide bearing 23*f* which is made of resin.

So, in the present embodiment, as shown in FIG. 1, a resin coating layer 23*e* for the developing sleeve 23*a* is provided on both the outer periphery of the small-diametered portion 23*j* and besides the outer periphery of the cylindrical portion 23*b*. The resin material forming the resin coating layer 23*e* contains electrically conductive particulates such as crystalline graphite which is rich in solid lubricity, and therefore, the slidability thereof with the slide bearing 23*f* is enhanced and the wear of the slide bearing can be suppressed and, at the same time, the rotational torque of the developing sleeve 23*a* can be suppressed to a small level.

The small-diametered portion 23*j* and the flange portion 23*c* are provided only in one end portion of the developing sleeve and the magnet 23*d* is inserted from the other end portion, not shown, of the developing sleeve.

Figure 6:
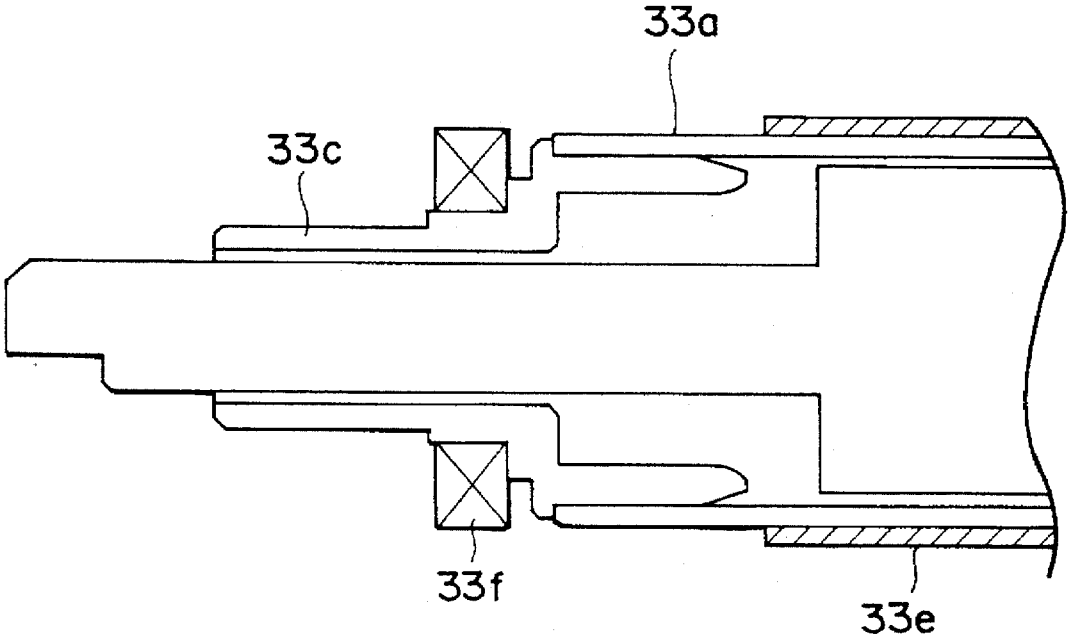
FIG. 6 is a cross-sectional view of one end portion of a developing sleeve.

This other end portion, not shown, can assume the construction shown in FIG. 6.

Figure 3:
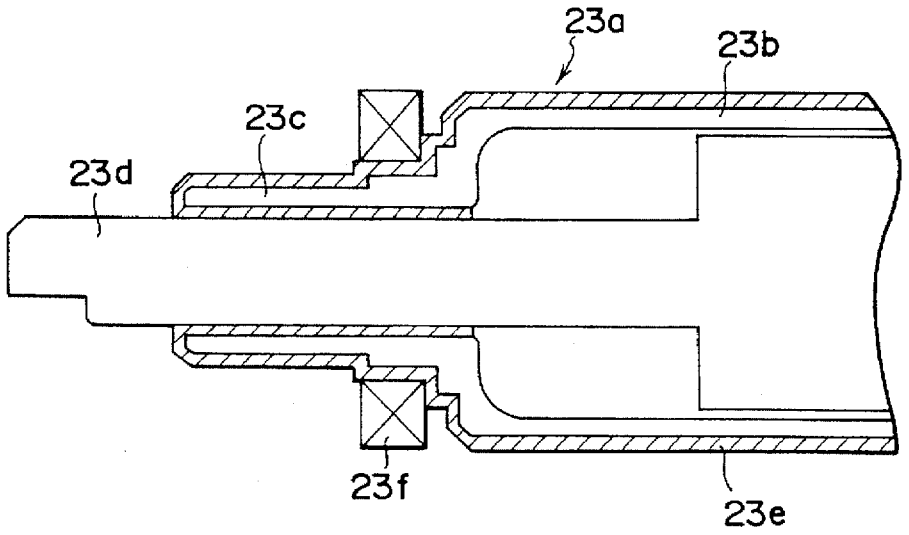
FIG. 3 is a cross-sectional view of a developing sleeve according to another embodiment of the present invention.

FIG. 3 shows a developing sleeve according to another embodiment of the present invention.

As shown in FIG. 3, the magnet 23*d* contacts the inner peripheral portion of the developing sleeve 23*a* (the flange portion 23), if the resin coating layer 23*e* is also formed on this inner peripheral portion, then the slidability of the developing sleeve 23*a* could be enhanced.

While the embodiments of the present invention have been described above, the present invention is not restricted to these embodiments, but all modifications within the technical idea of the present invention are possible.

What is claimed is:

1. A developing sleeve comprising:

a metal sleeve having a circular cross-section;

a one piece rotation prohibiting portion formed at an end portion of said sleeve by drawing the end portion thereof, said rotation prohibiting portion having a non-circular cross-section; and a gear fixed to the rotation prohibiting portion.

2. A developing sleeve according to claim 1, wherein the rotation prohibiting portion has a D-shaped cross-section.

3. A developing sleeve according to claim 1, wherein said metal sleeve includes a small diameter portion having a circular cross-section formed by drawing, said small diameter portion being disposed nearer a central portion of said metal sleeve than the rotation prohibiting portion.

4. A developing sleeve according to claim 3, wherein said metal sleeve is coated with resin from a central area to the small diameter portion.

5. A developing sleeve according to claim 4, wherein the resin coating layer contains solid lubricity material.

6. A developing sleeve according to claim 4, wherein the small diameter portion is rotatably supported by a slide bearing.

7. A developing sleeve according to claim 1, wherein the rotation prohibiting portion is provided on only one side of said metal sleeve.

8. A developing device comprising:

a developer containing portion for containing a developer therein;

a developing sleeve for carrying developer in the developer containing portion, said developing sleeve comprising a metal sleeve having a circular cross-section, and a one piece rotation prohibiting portion formed at an end portion of the metal sleeve by drawing the end portion thereof, said rotation prohibiting portion having a non-circular cross-section; and a gear fixed to the rotation prohibiting portion.

9. A developing device according to claim 8, further comprising a magnet provided in said metal sleeve.

10. A developing device according to claim 8, further comprising a regulating member for regulating a layer thickness of developer carried on said developing sleeve.

11. A developing device according to claim 8, wherein the rotation prohibiting portion has a D-shaped cross-section.

12. A developing device according to claim 8, wherein said metal sleeve includes a small diameter portion having a circular cross-section formed by drawing, said small diameter portion being disposed nearer a central portion of said metal sleeve than the rotation prohibiting portion.

13. A developing device according to claim 12, wherein said metal sleeve is coated with resin from a central area to the small diameter portion.

14. A developing device according to claim 13, wherein the resin contains solid lubricity material.

15. A developing device according to claim 13, further comprising a slide bearing for rotatably supporting the small diameter portion.

16. A developing device according to claim 8, wherein the rotation prohibiting portion is provided on only one side of said metal sleeve.

* * * * *

UNITED STATES PATENT AND TRADEMARK OFFICE

CERTIFICATE OF CORRECTION

PATENT NO. : 5,701,562

DATED : December 23, 1997

INVENTOR(S) : ARAKI et al.

It is certified that error appears in the above-identified patent and that said Letters Patent is hereby corrected as shown below: On the title page:Item

[56] At References Cited

"Kalyandura" should read --Kalyandurg--.

Column 1

Line 13, "of" should be deleted.
Line 56, "the" (first occurrence) should be deleted; and "of" should be deleted.

Column 3

Line 66, "surface" should be deleted.

Column 4

Line 38, "23*f*" should read --23*f*,--.
Line 42, "besides" should be deleted.

Column 5

Line 4, "one piece" should read --one-piece--.
Line 20, "coating layer" should be deleted.

UNITED STATES PATENT AND TRADEMARK OFFICE

CERTIFICATE OF CORRECTION

PATENT NO. : 5,701,562

DATED : December 23, 1997

INVENTOR(S) : ARAKI et al.

It is certified that error appears in the above-identified patent and that said Letters Patent is hereby corrected as shown below:

Column 6

Line 2, "one piece" should read --one-piece--.

Signed and Sealed this

Twenty-first Day of July, 1998

Bruce Lehman

*Attest:*

BRUCE LEHMAN

*Attesting Officer*

*Commissioner of Patents and Trademarks*